United States Patent [19]

Barton

[11] 3,990,597

[45] Nov. 9, 1976

[54] CONTAINER AND GAVAGE TUBE ADAPTER WITH VENT

[75] Inventor: Raymond W. Barton, Evansville, Ind.

[73] Assignee: Mead Johnson & Company, Evansville, Ind.

[22] Filed: Sept. 9, 1975

[21] Appl. No.: 611,779

[52] U.S. Cl. ..... 215/11 B; 215/307

[51] Int. Cl.[2] ..... B65D 51/16

[58] Field of Search ..... 215/11 B, 307, 309; 220/303, 366; 222/478

[56] References Cited

UNITED STATES PATENTS

| | | | |
|---|---|---|---|
| 2,109,720 | 3/1938 | Deschner | 222/478 |
| 3,044,649 | 7/1962 | Boston | 215/11 B |
| 3,838,784 | 10/1974 | Barton | 215/11 B |

*Primary Examiner*—Donald F. Norton

*Attorney, Agent, or Firm*—R. E. Carnahan; R. H. Uloth

[57] ABSTRACT

The present invention provides a container with a removable adapter cap for use in nasogastric tube feeding. The adapter cap and container include cooperating elements which provide vent means to secure steady flow during delivery of the liquid dietary contents of the container.

4 Claims, 2 Drawing Figures

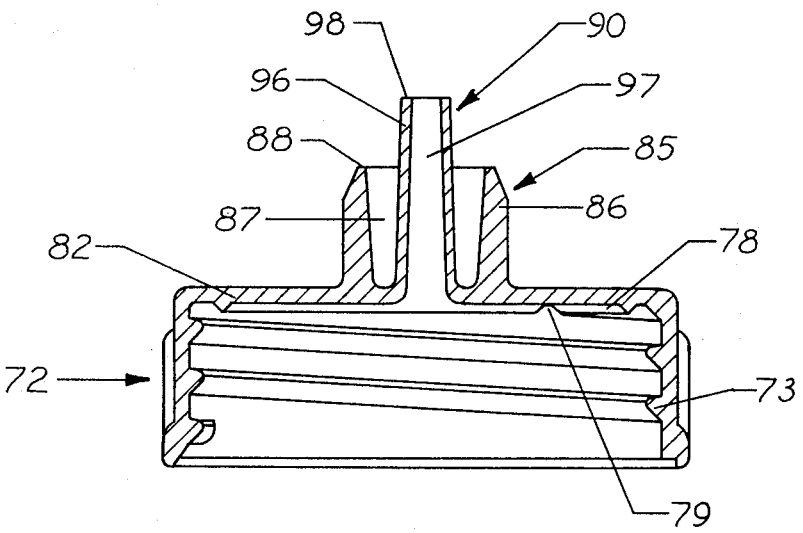
FIGURE II
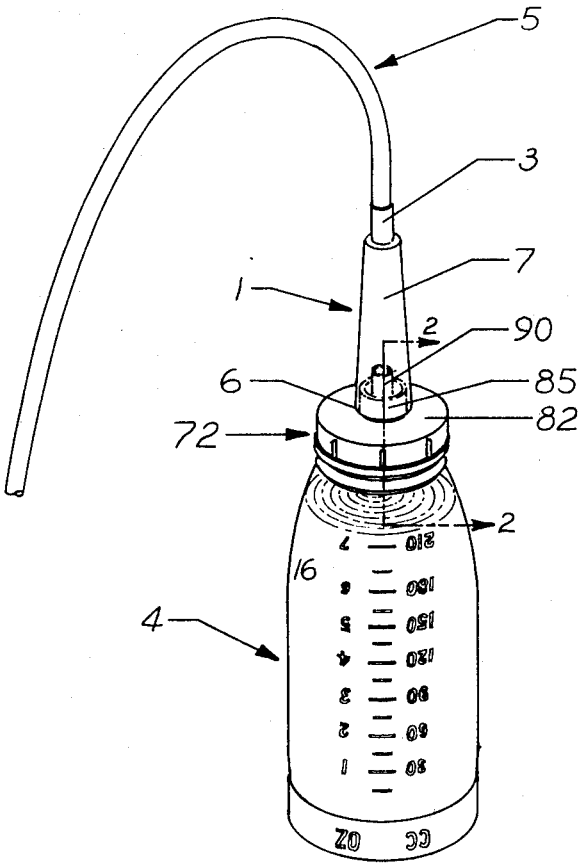
FIGURE I

CONTAINER AND GAVAGE TUBE ADAPTER WITH VENT

FIELD OF THE INVENTION

The invention involves a liquid diet feeding container having a vented closure structure. It differs from a nursing bottle in that the closure structure includes tubular means for connection of a nasogastric tube for gavage feeding of premature infants and debilitated patients.

DESCRIPTION OF THE PRIOR ART

U.S. Pat. No. 3,838,784 patented Oct. 1, 1974, by Raymond W. Barton and Joseph T. Herron discloses a cap for a nursing bottle which is modified for use with a gavage tube. The cap incorporates a sealing bead comprising a continuous circumferential annular ridge on the underside of the transverse wall portion of the cap. The ridge bears against the finish of the bottle or against an overlying frangible aluminum seal which is interposed between the bottle finish and the cap. The cap in the Barton and Herron patent is equipped with a vent tube containing a ball-check valve.

U.S. Pat. No. 3,865,107 patented Feb. 11, 1975, by Raymond W. Barton discloses a tube feeding apparatus for the nasogastric feeding of infants having a flexible calibrated connector attached to an adapter cap of a diet feeding container, but there is no disclosure of vent means in the Barton patent.

U.S. Pat. No. 3,044,649 patented July 17, 1962 by Frank E. Boston is concerned with a vented nurser employing a nipple and nipple cap combination in which an interrupted sealing bead in the nipple cap engages the flange of the nipple which overlies the finish of the nursing bottle. The resilient flange of the nipple is provided with apertures which communicate with the interruptions in the seal bead and provide vent means. The apertures in the nipple flange collapse in response to tightening of the nipple cap and thus confer adjustability upon the vent means to prevent leakage.

SUMMARY OF THE INVENTION

For the feeding of debilitated patients who are either unable to eat or refuse to eat, the present invention provides a container for delivery of a liquid dietary which is similar to a nursing bottle but which employs an adapter cap for receiving a nasogastric tube. Pre-filled containers may be employed which is a convenience for hospital use since the sterile dietary need not be transferred to another container prior to use, thus minimizing the labor involved on the part of hospital personnel and reducing the possibility of contamination. An adapter cap is provided for connection to the container to which the gavage tube is connected. The present invention involves unique vent means in the combination of adapter cap and liquid dietary container. The unit is also adapted for the gavage feeding of premature infants. For this purpose the adapter cap is sealably attached to a small graduated cylinder having a capacity of about 60 cc.

BRIEF DESCRIPTION OF THE DRAWINGS

FIG. I is a perspective view of one embodiment of the invention showing the combination of pre-filled liquid dietary container, adapter cap, flexible connector, and gavage tube.

FIG. II is a cross-sectional view along line 2—2 of FIG. II of the adapter cap apart from the dietary feeding container.

DETAILED DESCRIPTION OF THE INVENTION

In FIG. I, the container member for the liquid dietary 16 is shown by numeral 4 having the adapter cap 72 sealably received on the neck portion of the container. The adapter cap 72 is formed with hub 85 in the central portion of the transverse wall portion 82 thereof for receiving the flexible connector 1 for the gavage tube 5. Flexible connector 1 has a transparent body portion 7 which is open at either end with the proximal end 6 affixed about the hub 85 of adapter cap 72. The distal end of flexible connector 1 terminates in fitment 3 to which gavage tube 5 is connected. In operation, the liquid dietary feeding container 4 is suspended in the inverted position so that the liquid dietary may flow from the container by gravity feed through flexible connector 1 into gavage tube 5 which is connected to an in-dwelling nasogastric tube in the subject being fed. The liquid diet feeding container is calibrated for measurement of the quantity of liquid dietary delivered. Note that in the embodiment shown in FIG. 1 that the calibrations are inverted so that they may be easily read when the container is in operation.

Details of construction of the adapter cap are shown in FIG. II. In this embodiment the adapter cap generally indicated by the numeral 72 is threaded about the interior walls as shown at 73. The threads are designed to be received on the threaded upstanding neck portion of the dietary container generally indicated by the numeral 4 in FIG. I. When adapter cap 72 is sealably received on container 4 by engagement of threads 73 with the threaded upstanding neck portion of container 4, the transverse wall portion 82 of the cap serves to close the open mouth portion of container 4. Depending from the underside of transverse wall portion 82 of cap 72 is a sealing bead 78. The sealing bead is located about the circumference of the transverse wall portion 82 of the cap and is placed so as to register with the finish of the bottle when the cap is affixed to the container. Sealing bead 78 terminates in a sharp annular ridge which forms a liquid-tight seal with the finish of the bottle when cap 72 is sealably affixed thereto. Sealing bead 78 has a notch-like discontinuity therein shown by the numeral 79 in FIG. II. The dimensions of discontinuity 79 are such that substantially no leakage of liquid diet 16 occurs through notch 79 and about threads 73 when the diet feeding container with adapter cap sealably affixed thereto is held in the inverted position during delivery of the liquid diet. The exact dimensions appropriate for a given container and a given liquid diet may be readily determined by routine experiment. For delivery of a liquid dietary having substantially the consistency of cow's milk, a sealing bead which depends 0.02 in. from the transverse wall portion of the cap and having a discontinuity of approximately 0.05in. in length is suitable.

Hub 85 is centered and stands upwardly about the center of transverse wall portion 82 of adapter cap 72. Hub 85 comprises an upstanding wall portion 86 terminating in a top marginal rim 88 which encloses an annular space 87. Centered within annular space 87 and formed concentrically with hub 85 is delivery tube 90 which is comprised of upstanding wall portion 96 terminating in a top marginal rim 98. Side walls 96 enclose an annular space 97 which is open at either end and provides a channel for flow of the liquid dietary to the exterior when affixed to the dietary container held in the inverted position. Side walls 96 of delivery tube 90 are longer than side walls 86 of central hub 85 so that the top marginal rim 98 of delivery tube 90 provides a tip for visualization of the flow of liquid dietary into transparent flexible connector 1 when the apparatus is inverted and in use.

The liquid diet feeding container 4 and the adapter cap 72 are fabricated of substantially rigid materials which are subject to only minimal deformation when the cap is sealably affixed to the container. By the use of substantially rigid materials, distortion of notch 79 which would interfere with the venting action intended is thus avoided. Suitable materials for container 4 are glass, linear polyethylene, or polycarbonate, and for the adapter cap polypropylene, or linear polyethylene.

What is claimed is:

1. A liquid diet feeding container which comprises in combination a container member for the liquid diet having an upstanding neck portion terminating in a top marginal rim circumscribing an open mouth portion, an adapter cap sealably received on said neck portion and having a transverse wall portion overlying the open mouth portion of said container, tubular means in said transverse wall portion of said adapter cap for delivery of the liquid diet when said container is in the inverted position, seal means defining an annular ridge depending from the underside of the transverse wall portion of said adapter cap terminating in a sharp annular ridge which abuts against the top marginal rim of said neck portion when said cap is sealably received thereon, said annular ridge having a notch-like discontinuity which communicates between the interior and exterior of said container when said cap is sealably received on the upstanding neck portion of said container, said discontinuity constituting vent means.

2. The liquid diet feeding container of claim 1 wherein the dimensions of said notch are such that substantially no leakage of liquid diet occurs therethrough during delivery of said liquid diet when said container is in the inverted position.

3. The liquid diet feeding container of claim 1 wherein said upstanding neck portion thereof is threaded and said adapter cap is a screw cap threadably received thereon.

4. The liquid diet feeding container of claim 1 wherein said container and said adapter cap are each fabricated of substantially rigid material virtually free of deformation when said cap is sealably affixed to said container.

* * * * *